United States Patent [19]

Twyford

[11] 4,004,121

[45] Jan. 18, 1977

[54] ELECTRICAL SWITCH WITH WIRE BEAM SPRING CONTACT CLOSER

[75] Inventor: Robert H. Twyford, Great Falls, Va.

[73] Assignee: Mechanical Enterprises, Inc., Springfield, Va.

[22] Filed: Apr. 4, 1974

[21] Appl. No.: 458,042

[52] U.S. Cl. ..... 200/275; 200/159 R; 200/5 A

[51] Int. Cl.[2] ..... H01H 13/70

[58] Field of Search ..... 200/275, 159 R, 241, 200/243, 254, 164 R, 159 A, 67 DA, 67 DB, 5 A

[56] References Cited

UNITED STATES PATENTS

| | | | |
|---|---|---|---|
| 2,547,214 | 4/1951 | Jones et al. | 200/275 X |
| 2,834,848 | 5/1958 | Ellwood | 335/133 X |
| 3,244,847 | 4/1966 | Erpel | 200/340 X |
| 3,588,416 | 6/1971 | Millan | 200/275 |
| 3,743,798 | 7/1973 | Pentecost | 200/159 R X |
| 3,845,264 | 10/1974 | Twyford | 200/5 A X |
| 3,854,018 | 12/1974 | Reynolds et al. | 200/5 A |
| 3,856,998 | 12/1974 | Sims | 200/159 R X |
| 3,886,335 | 5/1975 | Hendricks | 200/5 A X |
| 3,895,203 | 7/1975 | Leworthy | 200/159 R X |

FOREIGN PATENTS OR APPLICATIONS

| | | | |
|---|---|---|---|
| 606,437 | 1960 | Italy | 200/159 R |

*Primary Examiner*—Herman Hohauser
*Assistant Examiner*—William J. Smith

[57] ABSTRACT

An electric switch especially adapted for use in a variety of keyboard applications includes an elongated and generally straight wire beam spring which is fixedly supported at its ends in the switch housing with a center portion free to be flexed relative to the ends of the spring. The normal position of the wire beam spring has the center portion spaced from a pair of spaced contacts and an actuator mounted on the switch housing is depressed to flex this center portion from its normal position into engagement with the contacts and thereby close an electric circuit between such contacts.

9 Claims, 17 Drawing Figures

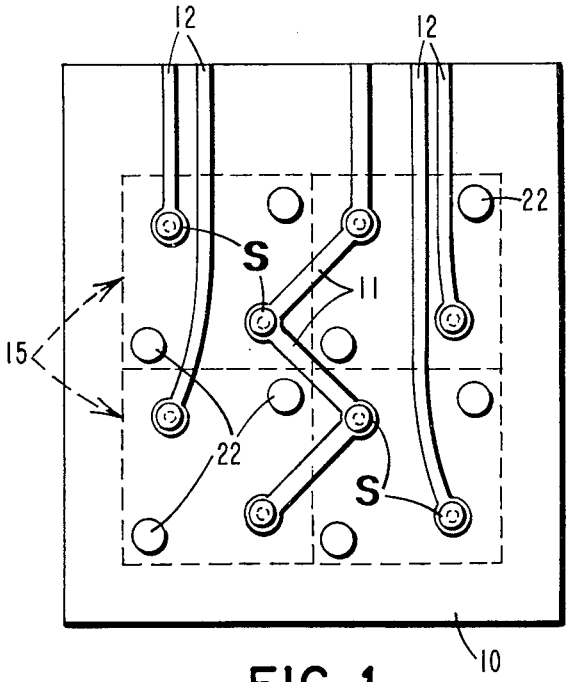
FIG. 1
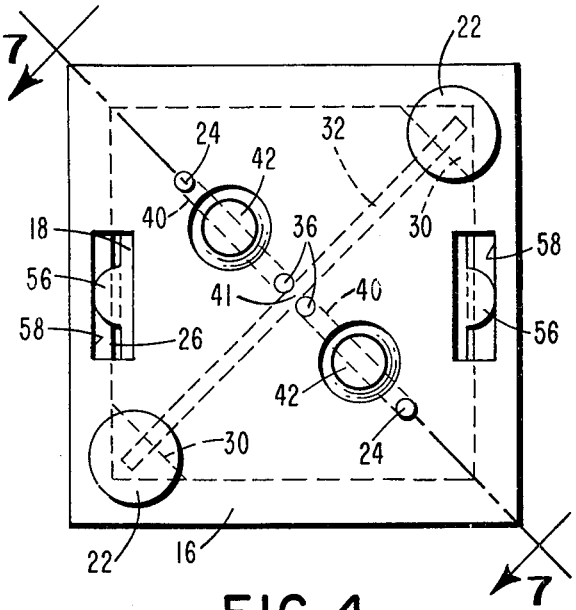
FIG. 4
FIG. 2
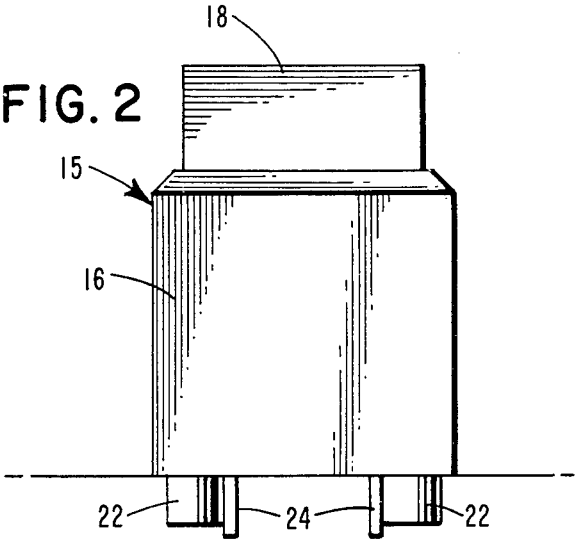
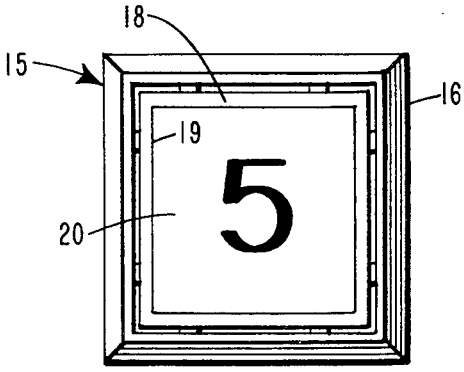
FIG. 3
FIG. 5
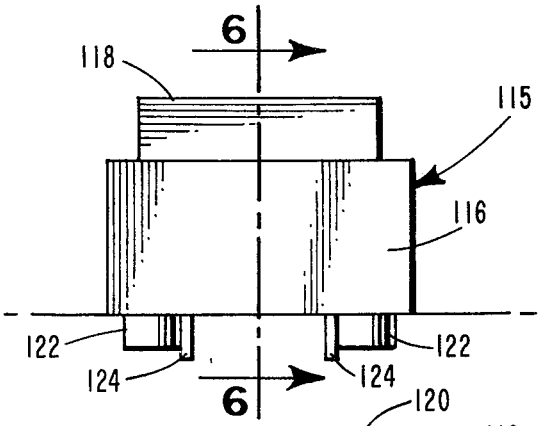
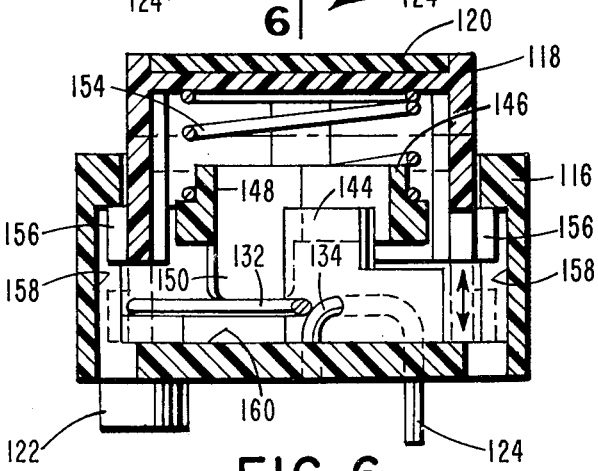
FIG. 6

ELECTRICAL SWITCH WITH WIRE BEAM SPRING CONTACT CLOSER

BACKGROUND OF THE INVENTION

1. Field of the Invention

The invention relates to the field of electric switches and specifically to normally open switches which incorporate a deflectable spring which is deflected by a manually depressible actuator from a normal position into engagement with contacts to close an electric circuit through the switch. These switches are well adapted for low priced units designed to be used in the keyboards of such hand-held devices as miniature electric calculators, adding machines, inventory input devices, etc. as well as in larger keyboard applications.

2. Description of the Prior Art

Computers, calculators, simple miniaturized adding machines and related data processing equipment have generated a vast number of uses for miniaturized switches. These switches must permit assembly of a multitude of such switches in keyboard arrangements where the keys or push buttons of the assembled switches, through internal electric circuits, carry out the computer, adding or data processing operation. Certainly, the cost of these keyboards, particularly in miniature and low cost equipment, to a large extent involves the cost of the multiple electric switches required for the keyboard.

Solid state adding machines and calculators, both desk type models and small pocket size adding machines or calculators, present a sizeable demand for keyboards employing miniaturized electric switches where depression of the keys or push bottons of the switches determines the carrying out of the required functions in the adding machine or calculator. Thus, the switches in closing circuits upon depression of their push buttons generate the requisite electrical signals for computers, calculators, pocket adding machines etc. to perform their output duties.

Numerous switch constructions have been developed for keyboards such as mentioned above. Such switch designs have ranged from mechanical-electrical proposals through elaborate electronic switching concepts. Considering the criticality of cost as a factor in keyboard construction, low initial investment, maintenance free operation and high operational reliability are prime requirements, but collectively they are difficult to achieve in miniaturized switches.

SUMMARY OF THE INVENTION

It is a principal object of this invention to provide a miniaturized, manually actuatable electric switch most suitable in generating electrically significant data by employing a multitude of these switches in computer, calculator, adding machine, etc. keyboards.

A further primary object of the invention is the production of a low cost reliable miniaturized switch which may be key or push button operated and is particularly suited for the multitude of keyboard applications.

A further object is to provide a key or push button operated switch with improved touch or feel in depressing and releasing the switch key or push button and which achieves long switch life.

It is also an object to provide a manually operable switch where a minimum of parts are required, many producable by plastic molding techniques, and assembly is simple to provide a low cost keyboard type switch.

The above mentioned objects, aims and purposes of this invention are substantially met by the present invention of a switch having an elongated wire beam spring which is supported at its ends by the switch housing and has a center portion free to be flexed relative to its ends and thereby be moved into circuit closing relation with a pair of housing supported spaced contacts. A plunger is appropriately mounted on the housing to be movable in deflecting the wire beam spring to achieve switch operation. This normally open switch incorporates an efficient and inexpensive simple mechanical construction.

BRIEF DESCRIPTION OF THE DRAWINGS

FIG. 1 is a bottom plan view showing four switches of the invention mounted in a cluster on a rectangular section of a printed circuit board.

FIG. 2 is a side elevational view of one form of switch of this invention.

FIG. 3 is a top plan view of the switch shown in FIG. 2.

FIG. 4 is a bottom plan view of the switch shown in FIG. 2.

FIG. 5 is a side elevational view of a more miniaturized form of the switch of this invention.

FIG. 6 is a sectional view taken of line 6—6 of FIG. 5.

DETAILED DESCRIPTION OF THE SWITCH INVENTION EMBODIMENTS

Figure 7:
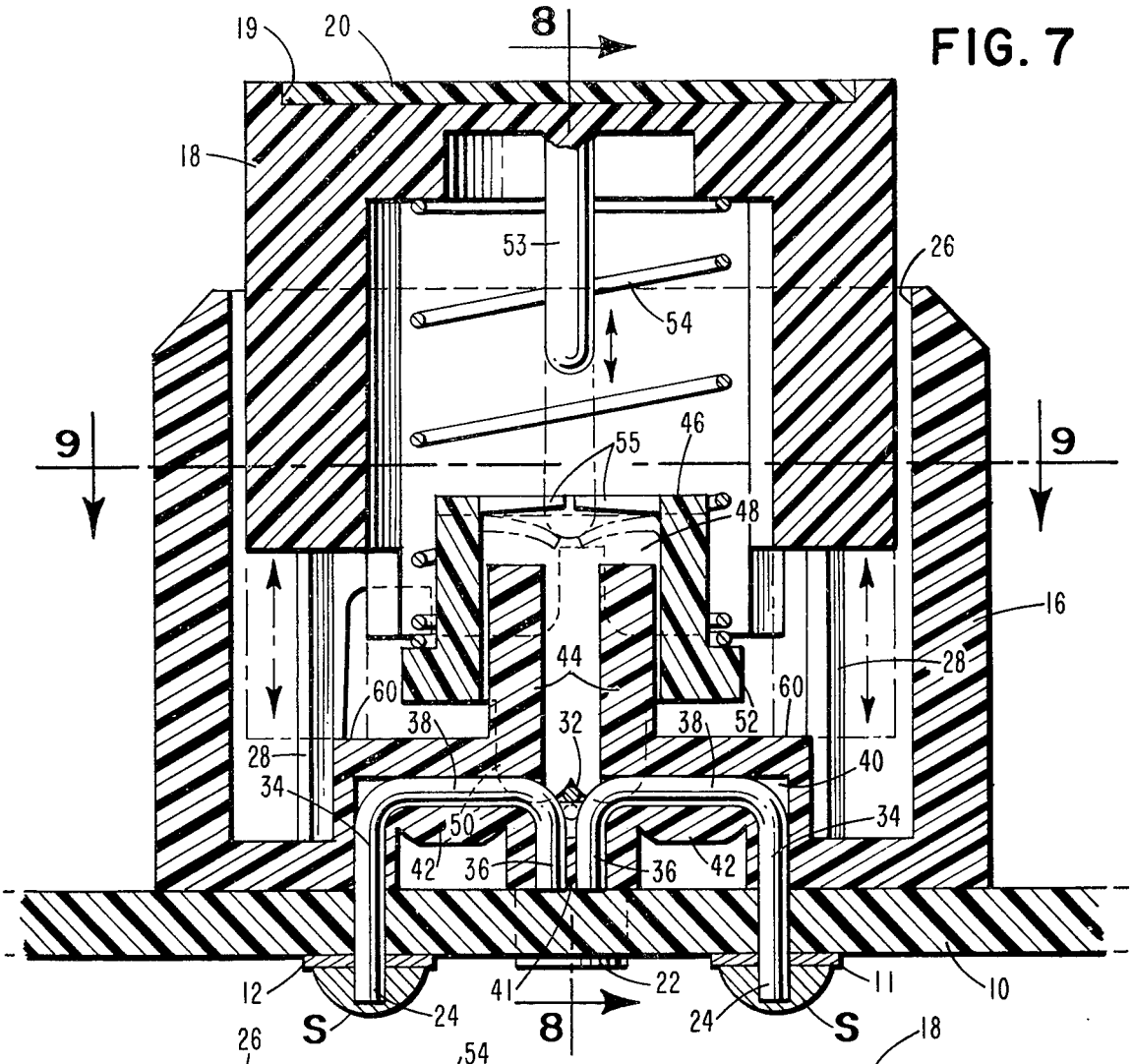
FIG. 7 is a sectional view taken of line 7—7 of FIG. 4.

Two embodiments are disclosed, although both incorporate basically the same components and operational features. FIGS. 2, 3, 4, 7, 8, 9, 10, 11, 14, and 15 illustrate one embodiment where the parts and space within the cavity of the switch housing are somewhat larger than those of the second embodiment. Also, the length of travel of the switch plunger to effect switch closing is correspondingly longer than that of the second embodiment.

FIGS. 5, 6, 12, 13, 16 and 17 relate to a highly miniaturized form of switch and illustrate the second embodiment. However, in connection with both embodiments, it is to be kept in mind that they are both quite miniature switches. Both have base dimensions of slightly less than one half inch square. The height of the housing, from its base to its top is a half inch for the larger switch and the smaller one in FIGS. 5 and 6 has a height of its housing of one-quarter inch.

The construction of the switch invention embodiments ideally lends itself to making the major components of the switch out of plastic material which may be formed by use of injection molding techniques. Thereby, both economical and mass production of these components can be achieved. Only the wire beam spring, switch contacts and actuator coil spring are appropriately made of metal material, and these can easily and cheaply be formed from wire stock using wire bending, coiling, etc. techniques.

FIG. 1 shows a bottom plan view of a typical printed circuit board layout, with four switches mounted abutting each other on a rectangular printed circuit board section 10, the bottom outline of the four clustered switches being shown in dotted lines. In this typical mounting, the common input lead 11 to the four switches on the board connects to one terminal of each of the four switches. The separate switch output leads, one for each switch, are illustrated by leads 12 on the underside of the board. As will be described hereinafter, the terminals for the switches extend downwardly through the printed circuit board 10 where they are easily connected to the desired circuitry of the board by being soldered at S to the leads 11 and 12.

FIGS. 2 and 3 show the exterior configuration of one switch. This switch 15 has a housing 16 providing a cavity 26 to carry the working parts of the switch, as will be described. A manually depressible plunger 18 is reciprocably mounted in the cavity of housing 16. The outer end of plunger 18 has a rectangular recess 19 which receives an appropriate marker 20 as shown in FIGS. 3 and 7. FIG. 3 exemplifies the marker 20 as displaying the legend "5" in the embodiment illustrated. Of course, the marker 20 for each switch on a keyboard application will bear the legend or indicia desired to indicate to the user, the function to be performed by depressing the individual switch keys. Also, the legend may be placed directly on the outer end of plunger 18, omitting recess 19 and marker 20.

The bottom of housing 16 has two alignment studs 22, as shown, which facilitate proper and firm positioning of the switch when mounted on a printed circuit board. These alignment studs 22 pass through appropriately located holes in the board to align the switch in the manner shown in FIG. 1. Referring further to FIG. 2, terminals 24 for connecting the switch onto circuit board leads 11 and 12 are illustrated. These terminals project down beyond alignment studs 22 so that they will pass through the circuit board and can be soldered at S to the leads on the circuit board in the manner best shown in FIGS. 7 and 8. The relative positioning of alignment studs 22 and terminals 24 on a switch is also shown in FIG. 4.

Figure 8:
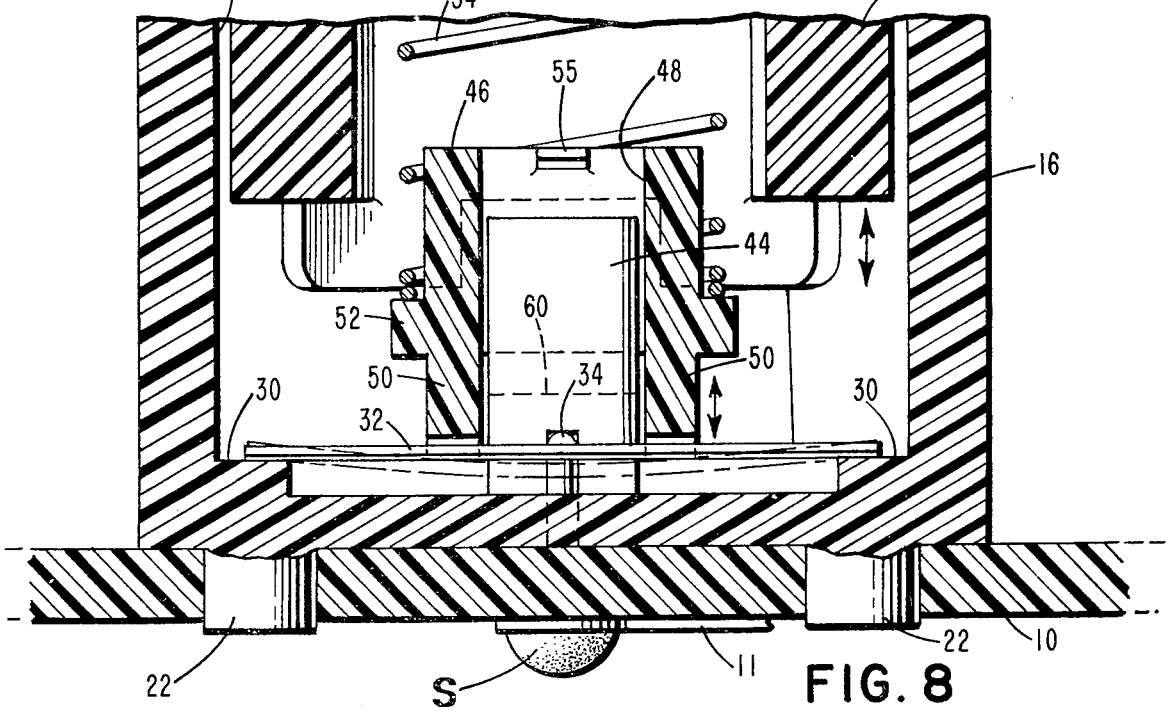
FIG. 8 is a partial sectional view taken of line 8—8 of FIG. 7.
Figure 9:
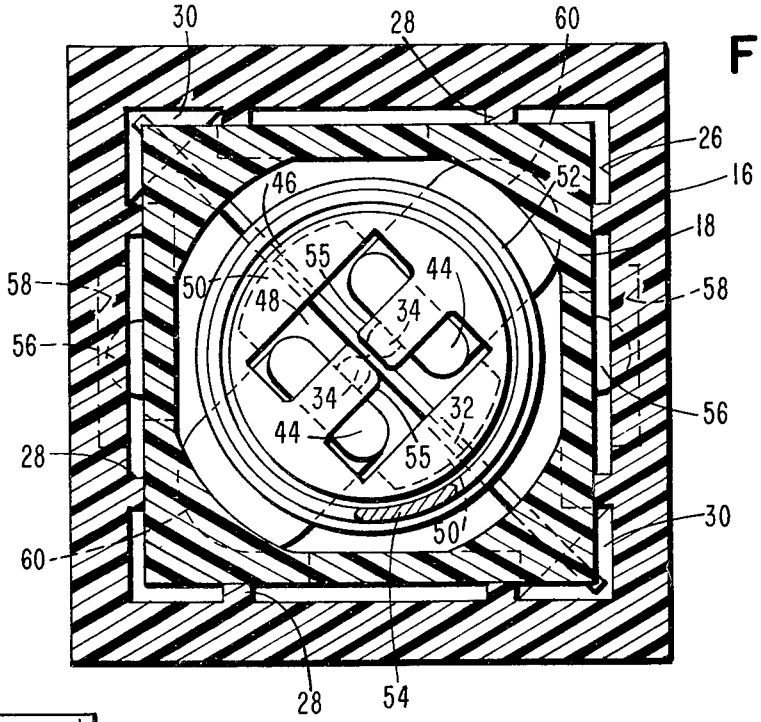
FIG. 9 is a sectional view taken of line 9—9 of FIG. 7.
Figure 10:
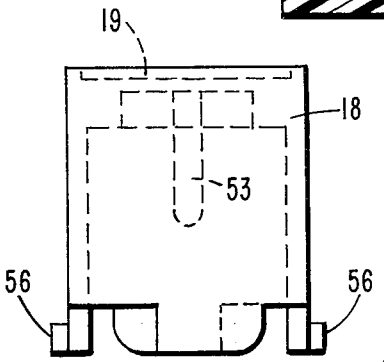
FIG. 10 is a side elevational view of the switch plunger for the switch shown in FIG. 7.
Figure 12:
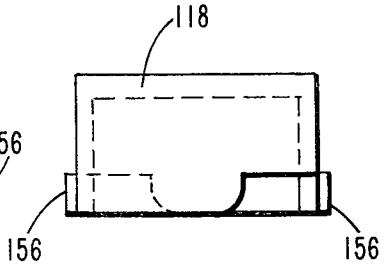
FIG. 12 is a side elevational view of the switch plunger for the switch shown in FIG. 6.

Referring to FIGS. 7, 8, and 9, the internal construction of switch 15 is illustrated in detail. The switch housing 16 provides an interior cavity 26 in which the switch plunger 18 is slideably received. Plunger 18 is generally cup-shaped with a closed outer end and a skirt extending down into the housing 16 cavity. The cavity 26 has ribs 28 projecting inwardly to guide and promote smooth sliding engagement of the exterior of plunger 18 within cavity 26. It will be recognized that, if desired, the ribbed surface could be provided on the exterior of plunger 18 rather than on the walls of cavity 26.

At the bottom of cavity 26 inside housing 16, there are provided two triangular shoulders 30 located at diagonally opposite corners of cavity 26. These shoulders support the opposite ends of an elongated wire beam spring 32 so that the center portion of this beam spring is free to be flexed downwardly from its normally straight condition, as shown in FIG. 8, to its bowed state as shown in phantom on FIG. 8. Beam spring 32 thus normally assumes a position where it extends straight across between shoulders 30 and is out of engagement with a pair of switch contacts which will be described. In its downwardly flexed condition, it moves into engagement with the switch contacts to close a circuit through the switch between such contacts.

Each of the two switch contacts, ending in solder terminals 24, is formed by an inverted J member 34. The long leg of each J member protrudes through the base of the housing to provide a terminal 24. The short legs 36 of the two members 34 are adjacent and parallel to one another, terminating at the bottom of housing 16 as shown in FIG. 7. Their upper ends curve away from each other and join intermediate legs 38 of the J members. The curved portions define a generally V-shaped cavity into which the wire beam spring 32 is flexed to engage the short legs 36 of J members 34 and thereby effect circuit closing. The intermediate leg 38 of each J member extends away from this generally V-shaped cavity, joining with the long leg which forms terminal 24. From FIG. 7 it will be appreciated that the inverted J members 34 lie in a plane which is perpendicular to the axis of the wire beam spring 32. Both the beam spring 32 and J members 34 can be made fron conductive metal wire stock of circular or other cross section as desired. Of course, the beam spring shall have sufficient resiliency to be flexed down against members 34 and then return to its straight normal position when plunger 18 is released.

In construction of the switch, the two J members are inserted into separate spaced pockets 40 which open through the bottom of the switch housing 16 and are separated at their adjacent ends by a bridge portion 41 in the base of housing 16. Since the switch housing 16 is preferably moulded from plastic material, the J members 34 can most easily be fixedly secured in their respective pockets 40 by employing a cup-shaped rotary spinning tool which is driven into each pocket 40 so that plastic material is formed into the configuration 42 and thus surrounds at least the intermediate leg 38 of each J member. This forming of the housing plastic material adjacent each pocket 40 over the legs of the J member not only secures it in position, but also provides an effective means for properly locating the short legs 36 and curved portions of the J members 34 to define the generally V-shaped cavity into which the wire beam spring 32 is pressed.

Figure 14:
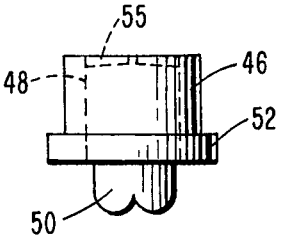
FIG. 14 is a side elevational view of the switch spring rider for the switch of FIG. 7.
Figure 11:
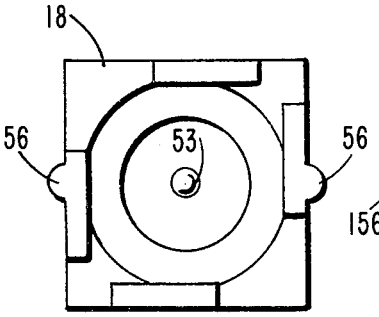
FIG. 11 is a bottom plan view of the switch plunger of FIG. 10.
Figure 13:
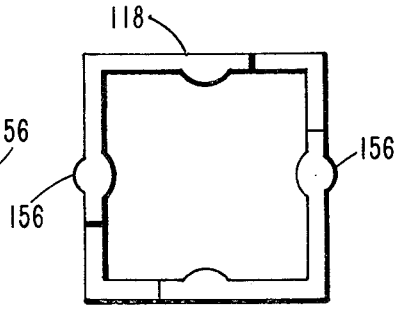
FIG. 13 is a bottom plan view of the switch plunger of FIG. 12.
Figure 15:
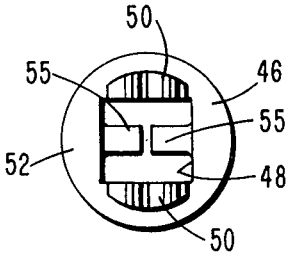
FIG. 15 is a bottom plan view of the switch spring rider of FIG. 14.
Figure 16:
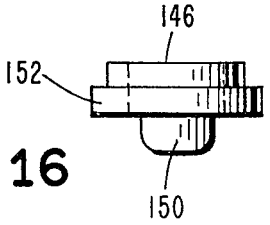
FIG. 16 is a side elevational view of the switch spring rider for the switch of FIG. 6.
Figure 17:
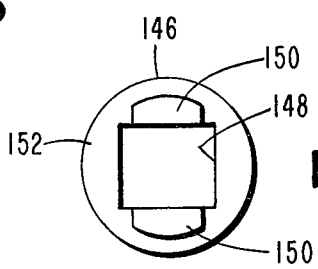
FIG. 17 is a bottom plan view of the switch spring rider of FIG. 16.

The bottom of cavity 26 in housing 16, above the portion enclosing the pockets 40 which house the J members, has space guide elements 44 extending into cavity 26 at the opposite sides of the beam spring 32. These guide elements 44 cooperate with a spring rider 46 to guide up and down movement of the spring rider in carrying out switch actuation and release. The spring rider 46 is shown in FIGS. 14 and 15 as having a rectangular central opening 48 which receives the guide elements 44 and spaced legs 50 on opposite sides of opening 48. In assembly of the switch, legs 50 extend downwardly and engage spaced locations along the length of beam spring 32 to carry out its flexing operation in switch closure.

Adjacent the base of legs 50 the spring rider 46 has a flange 52 on which one end of an actuator coil spring 54 rests. The outer end of actuator spring 54 extends into the recess formed by the skirt and closed outer end of cup-shaped plunger 18.

The spring 54 urges plunger 18 to its outer most position ready for switch actuation. However, its biasing force in this position is insufficient to press spring rider 46 down so as to flex the beam spring 32 to any substantial extent. Thus, the switch normally is in an open circuit condition as shown in FIGS. 7 and 8, the beam spring having sufficient resilience to maintain its condition in an essentially straight form supported on shoulders 30 as shown in FIG. 8. Upon depression of plunger 18, actuator spring 54 is compressed and exerts a greater biasing force on spring rider 46 which thereupon flexes wire beam spring 32 down at its central portion to engage and close the circuit between the contacts formed by J members 34.

In the embodiment as shown in FIGS. 7 and 8, for example, where the length of travel of the switch plunger is relatively long, as compared with the highly miniaturized form of switch of the second embodiment, it has been found desirable to provide a column 53 extending downwardly from the center of the closed outer end of cup-shaped plunger 18. This column extends within the skirt of the plunger and through the coils of actuator spring 54 ending at a point disposed above spring rider 46. Spring rider 46 is provided with a pair of inwardly extending plastic spring fingers 55. These fingers extend inwardly from the opposite sides of spring rider opening 48 as best shown in FIGS. 7, 9, 14 and 15, ending immediately adjacent each other at the center of spring rider 46. The column 53 on plunger 18 is of such length that upon depression of the plunger, the end of column 53 will engage plastic spring fingers 55 at a predetermined point in downward travel of the plunger. This depresses the spring fingers and thereby imparts and more positive force to the spring rider 46 to achieve switch closing actuation. The benefit of the combination of column 53 and spring fingers 55 is achieved by obtaining a more precise point of switch closing operation during the extent of downward travel of the plunger. Also, with the longer length of plunger travel in this embodiment, the spring characteristics for actuator spring 54 are not as critical to switch operation where the column 53 and spring fingers 55 are employed.

The plunger 18 is retained within the cavity 26 of housing 16, and thereby the other components of the switch kept in assembled relationship, by projections 56 on the lower end of the skirt of plunger 18. These projections, located on opposite sides of the plunger 18, engage in recesses 58 formed in the opposite walls of cavity 26. Each recess extends upwardly from the base of housing 16, terminating in a shoulder partway up the wall of cavity 26. Thus, the projections 56 on the plunger skirt, in the unactuated or normal condition of the switch, engage the shoulders at the upper ends of recesses 58 to limit upward movement of the plunger 18.

In assembly of the switch, with the wire beam spring 32, spring rider 46 and actuator spring 54 in position beneath the plunger, the plunger 18, which is preferably formed of plastic material, is pressed down into position with the projections 56 on the plunger skirt yielding inwardly during initial positioning of the plunger and snapping into place within recesses 58 when the plunger has been pressed sufficiently down into the cavity 26 of housing 16. Thereafter, the projections 56 will prevent the plunger 18 from moving up beyond the shoulders at the upper ends of recesses 58. It would normally never be necessary to disassemble the switch, but should such be desired, it may be disassembled by prying the skirt of the switch plunger inwardly so that projections 56 are disengaged from recesses 58 and then the plunger 18 may be pulled upwardly.

A further important feature of the switch of this invention resides in the downward limit stop for plunger 18 in carrying out switch actuation. Whereas downward movement of the plunger 18 will compress actuator spring 54 to impart a biasing force on spring rider 48 sufficient to flex wire beam 32 into circuit closing engagement with members 34, as shown in phantom on FIG, 7, the bottom end of the skirt on plunger 18 engages with the ledges 60, lying at the bottom of cavity 26 in housing 16. Thus, any excess downward pressure which might be applied to the top of plunger 18 is transmitted through the plunger to the bottom of housing 16 and damage to the switch actuating parts and particularly to wire beam spring 32 is avoided. The lower most position of plunger 18 is shown in phantom on FIG. 7.

The more miniaturized version of the switch of this invention shown in FIGS. 5, 6, 12, 13, 16 and 17 is essentially the same in its construction as that of the switch embodiment heretofore described with reference to the other drawing figures. Similar to the previously described embodiment, it has a housing, wire beam spring, inverted J members to form the switch contacts, a spring rider and an actuator spring. Detailed description of this more miniaturized embodiment is not deemed necessary. The parts in this embodiment corresponding to those of the hereinbefore described embodiment are numbered similar to those heretofore described, but each corresponding part number has a "1" added thereto.

From the above description, it will be readily appreciated that the switch of this invention and a keyboard embodying a multiplicity of such switches, solves a number of problems in providing an inexpensive construction enabling low keyboard cost while still providing good switch reliability. The switch of this invention possesses an extremely uncomplicated mechanism and is operable in an effecient manner with a minimum of moving parts.

It is to be understood that the construction, form and embodiments of the invention herein generally described are to be taken only as prefered representations of the invention and that various changes and modifications in the arrangement of the components, parts, units, elements etc. may be resorted to without departing from the disclosure of the invention or the scope of the appended claims.

I claim:

1. A switch comprising:

a housing having a cavity therein opening upwardly from said housing;

a pair of switch contacts supported against movement by said housing and extending inwardly of said cavity;

an elongated wire beam spring in said cavity supported adjacent its ends by said housing with a center portion free to be flexed, said center portion passing above said contacts and having a normal position spaced from said contacts whereat the electric circuit between said contacts is open;

an actuator mounted in said cavity to flex said center portion of said wire beam spring from said normal position to engage said contacts upon depression of said actuator, said actuator including a plunger reciprocably mounted in the open end of said cavity with an actuator spring beneath said plunger to be compressed by said plunger and flex said center portion of said beam spring;

a spring rider interposed between said wire beam spring and said actuator spring, said rider having spaced legs engaging said wire beam spring at points along the beam spring to flex said beam spring into circuit closing engagement with said contacts;

said plunger carrying column means extending toward said spring rider and spring finger means being provided on said spring rider, said column means engaging said spring finger means at a predetermined point in travel of said plunger to apply force through said finger means to said spring rider in effecting switch actuation.

2. A switch comprising:

a housing having a cavity therein;

a pair of switch contacts supported against movement by said housing and extending inwardly of said cavity;

an elongated wire beam spring in said cavity supported adjacent its ends by said housing with a center portion free to be flexed, said center portion passing above said contacts and having a normal position spaced from said contacts whereat the electric circuit between said contacts is open;

said contacts being in the form of inverted J members with the short legs of said members being adjacent each other and the long legs thereof protruding through the base of said housing to provide terminals for connection of the switch in use, the curve of the J members away from their adjacent short legs defining a generally V-shaped cavity into which the wire beam spring is flexed in circuit closing; and an actuator mounted in said cavity to flex said center portion of said wire spring from said normal position to engage said contacts upon depression of said actuator and close said electric circuit between said contacts.

3. A switch as recited in claim 2 wherein said J members have the intermediate legs thereof aligned with said short legs adjacent each other.

4. A switch comprising:

a housing having a cavity therein;

a pair of switch contacts supported against movement by said housing and extending inwardly of said cavity;

an elongated wire beam spring in said cavity supported adjacent its ends by said housing with a center portion free to be flexed, said center portion passing above said contacts and having a normal position spaced from said contacts whereat the electric circuit between said contacts is open;

said cavity having a generally rectangular cross section with said wire beam extending diagonally of and supported on shoulders at corners of said rectangular cross section; and an actuator mounted in said cavity to flex said center portion of said wire spring from said normal position to engage said contacts upon depression of said actuator and close said electric circuit between said contacts.

5. A switch comprising:

a housing having a cavity therein;

a pair of switch contacts supported against movement by said housing and extending inwardly of said cavity;

an elongated wire beam spring in said cavity supported adjacent its ends by said housing with a center portion free to be flexed, said center portion passing above said contacts and having a normal position spaced from said contacts whereat the electric circuit between said contacts is open;

an actuator mounted in said cavity to flex said center portion of said wire spring from said normal position to engage said contacts upon depression of said actuator and close said electric circuit between said contacts, said actuator including a spring rider engaging with said wire beam spring to flex said center portion and spaced guide elements extending past the sides of said beam spring cooperating with said spring rider to guide its movements in switch actuation and release.

6. A switch as recited in claim 1 wherein said J members are disposed in pockets opening through the base of said housing and retained therein by housing material formed over the legs of the J members.

7. A switch as recited in claim 6 wherein said V-shaped cavity is defined by spaced inverted J members disposed in a plane generally normal to the axis of said wire beam spring.

8. A switch as recited in claim 7 wherein said J members have their long legs protruding through the base of said housing and are of a circular cross section wire to accommodate solder connection of the switch in use.

9. A switch comprising:

a housing having a cavity therein;

a pair of switch contacts supported against movement by said housing and extending inwardly of said cavity;

an elongated wire beam spring in said cavity supported adjacent its ends by said housing with a center portion free to be flexed, said center portion passing above said contacts and having a normal position spaced from said contacts whereat the electric circuit between said contacts is open, said switch contacts curving away from each other to define a generally V-shaped cavity into which the wire beam spring is flexed in circuit closing; and an actuator mounted in said cavity to flex said center portion of said wire spring from said normal position to engage said contacts upon depression of said actuator and close said electric circuit between said contacts.

* * * * *